US007481075B2

(12) United States Patent
Lindenman

(10) Patent No.: US 7,481,075 B2
(45) Date of Patent: Jan. 27, 2009

(54) JEWELRY PIECE WITH A REPLACEABLE-EXCHANGEABLE SETTING AND ATTACHMENT MECHANISM AND SETTING APPARATUS THEREFOR

(75) Inventor: Jacques Lindenman, 240b Haroeh Street, Ramat Gan (IL) 52301

(73) Assignees: Ovadia Diamonds Ltd., Ramat Gan (IL); Jacques Lindenman, Ramat Gan (IL)

( * ) Notice: Subject to any disclaimer, the term of this patent is extended or adjusted under 35 U.S.C. 154(b) by 218 days.

(21) Appl. No.: 11/442,018

(22) Filed: May 25, 2006

(65) Prior Publication Data

US 2007/0068195 A1 Mar. 29, 2007

(30) Foreign Application Priority Data

Sep. 26, 2005 (IL) ..... 171089

(51) Int. Cl.
*A44C 17/02* (2006.01)

(52) U.S. Cl. ..... 63/29.1; 63/15

(58) Field of Classification Search ..... None
See application file for complete search history.

(56) References Cited

U.S. PATENT DOCUMENTS

| | | | | |
|---|---|---|---|---|
| 2,493,285 | A * | 1/1950 | Granat | 63/15.2 |
| 2,775,878 | A | 1/1957 | Eichhorn | |
| 3,180,112 | A | 4/1965 | Lefkowitz | |
| 4,374,470 | A | 2/1983 | Isaacson | |
| 5,077,989 | A | 1/1992 | Dillabaugh | |
| 5,133,195 | A | 7/1992 | Appelbaum et al. | |
| 5,419,158 | A * | 5/1995 | Sandberg et al. | 63/15.4 |
| 6,131,408 | A | 10/2000 | Gill | |

FOREIGN PATENT DOCUMENTS

| | | |
|---|---|---|
| FR | 2 133 013 | 11/1972 |
| JP | 09-224724 | 9/1997 |
| JP | 11-305671 | 11/1999 |

* cited by examiner

*Primary Examiner*—Jack W. Lavinder
(74) *Attorney, Agent, or Firm*—Lipsitz & McAllister, LLC

(57) ABSTRACT

A jewelry piece having a replaceable/exchangeable jewelry setting, the piece being adapted to allow an option for it to be assembled with either one jewelry setting or a combination of jewelry settings. In one embodiment the jewelry piece comprises an attachment mechanism which uses a pin, latch, magnet or combination thereof for quick and easy manual replacement/exchange of the setting.

12 Claims, 6 Drawing Sheets

JEWELRY PIECE WITH A REPLACEABLE-EXCHANGEABLE SETTING AND ATTACHMENT MECHANISM AND SETTING APPARATUS THEREFOR

The present disclosure relates to the subject matter disclosed in Israel application number 171089 of Sep. 26, 2005, which is incorporated herein by reference in its entirety for all purposes.

FIELD OF INVENTION

The present invention relates to jewelry, particularly jewelry comprising settings for precious stones.

BACKGROUND OF THE INVENTION

Jewelry pieces such as rings which are designed to allow their gem-stone settings to be removed and replaced with another setting have been described in the art.

Such capability has been found desirable so as to allow a different look for the jewelry, for example, to better suit a particular occasion, or simply to change the look of the jewelry piece.

Examples of such jewelry is disclosed in U.S. Pat. No. 4,374,470 to Isaacson and U.S. Pat. No. 5,077,989 to Dillabough.

U.S. Pat. No. 4,374,470 describes a ring having a means for inserting a replaceable insert unit containing a gem stone or any other type of setting such that the insert unit is securely held in place in a mounting but can be readily replaced by a similar unit containing another setting. The mounting is adapted to hold a sleeve with a hinged door that fits across the inside opening. The setting is positioned in a crown and both are soldered within a casing having projecting edges that fit snugly within and project through a sleeve that is soldered inside the mounting. The gem stone, casing and crown constitute the replaceable unit.

U.S. Pat. No. 5,077,989 discloses an interchanging setting for jewelry with male and female findings, for joining the setting to the jewelry. The female finding contains tapered lips which form a slotted key way, and an internal spring to provide bias against a key when inserted into the key way. The male finding has a key made up of a bar pin with tabs extending perpendicular from the bar pin. The key fits into the key way with the tabs extending out into the slotted key way. As the key is inserted the spring provides a bias. The key is turned 90 degrees and the tabs rotate under the tapered lips until the tabs rest in notches on the lips. The spring holds the key firmly in place. Conventional fingers attached to the male finding provide a mount for a stone or other desired setting.

SUMMARY OF THE INVENTION

The present invention relates to jewelry pieces, including ornamental pieces, which are designed to have settings, such as gemstone settings, attached thereto. The present invention further relates to an attachment mechanism for use with such jewelry pieces and settings or setting apparatus for use therewith.

The jewelry piece according to the present invention has a replaceable/exchangeable jewelry setting and is adapted to allow an option for said piece to be assembled with either one jewelry setting or a combination of jewelry settings. The one jewelry setting can be, for example, a central (solitaire) gem-stone setting or a wing gem-stone setting. The combination of settings, for example, can be the central setting combined with the wing setting (or other type settings) or combined with more than one other such setting.

The attachment mechanism and setting apparatus of the present invention are a mechanism and apparatus adapted for providing the afore-mentioned flexibility of gem-stone setting arrangement. The mechanism may comprise a pin, clasp, magnets, and so on, for such purpose. The setting apparatus comprises one or more settings that correspond to such an attachment mechanism and the jewelry piece and as such may comprise one or more holes, notches, housings, etc.

For convenience, the term ring will be used hereinafter to denote a broad variety of jewelry or ornamental pieces, including but not limited to: rings, earrings, bracelets (wrist/ankle, etc.), necklaces, belt buckles, head-dress pieces, and so on, adapted to have a jewelry setting assembled or attached thereto.

The term jewelry piece is meant to denote such a ring (jewelry or ornamental pieces) further comprising a jewelry setting, typically with a gem-stone held therein.

It is a particular feature of the ring of the present invention that the settings thereof can be removed and selectively replaced. For instance, a central or solitaire setting and a "wing" setting (i.e. a setting intended to hold gems on either side of the solitaire setting) may both be part of the ring; or just the solitaire setting or just the wing setting may be set thereon. Additional or alternative settings may also be present.

The above feature can be realized by using a number of different attachment mechanisms, those which are novel and constitute another particular feature of the invention and otherwise, several of which a number of examples will be illustrated.

DETAILED DESCRIPTION OF THE DRAWINGS

The invention may be more clearly understood upon reading of the following detailed description of non-limiting exemplary embodiments thereof, with reference to the following drawings, in which.

DETAILED DESCRIPTION OF THE INVENTION

Figure 8:
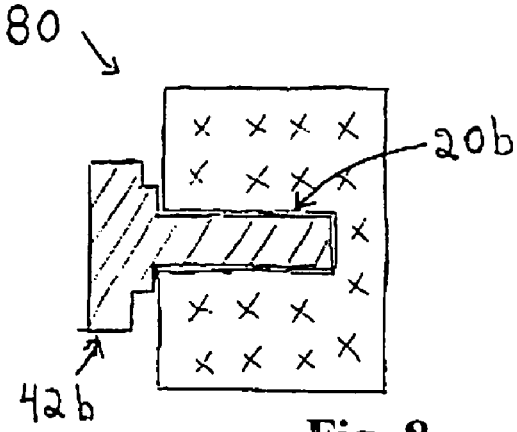
FIGS. 8-15 illustrate additional exemplary embodiments of attachment mechanisms according to the present invention.

Referring to the figures, there is shown a jewelry piece represented by a ring 10 having an inner surface 12, an outer surface 14, a front surface 16, and a rear surface 18. An opening or hole 20 leads from the front to the rear surface and there is an annular separation element 21 typically disposed essentially midway in the hole. It is important to note that the hole 20 need not be completely through the ring, in other words it need not be a through-hole (for example, as seen in FIG. 8), however a through-hole is likely to achieve a somewhat stronger attachment, and the hole 20 is in most cases the hole is shown as a through-hole in the figures.

The ring 10 further comprises a solitaire setting 22 and a wing setting 24; the solitaire setting having two lower projections 26 each having a hole 28 corresponding with the hole 20.

The solitaire setting 22 has branches 30 (four branches in the embodiments illustrated in the figures), which are designed to hold a gem (not shown) and these branches have outer surfaces 32. The wing setting 24 has two pairs of outer branches 34 and two pairs of inner branches 36 having inner surfaces 38. The outer surfaces 32 of the branches 30 of the solitaire setting 22 and the inner surfaces of the inner branches 36 of the wing setting 24 are typically designed to correspond with each other in a smooth and elegant manner (best seen in FIG. 4A).

The projections 26 of the solitaire setting 22 are separated from each other by a distance corresponding to the thickness of the ring 10. This distance should be such that the setting 22 can be easily slid over the front and rear surfaces 14 and 16, however, typically there is some friction between the setting and the surfaces which helps to hold it in place during assembly. The branches 34 of the wing setting 24 are similarly separated by a distance corresponding to the thickness of the ring 10, typically with the same fit on the surfaces 14 and 16 as just described. The ring 10 may comprise a ring projection 39 for helping to align the settings 22 and 24 with the ring's hole 20 upon assembly of the ring. In such case, the solitaire setting 22 typically comprises an opening or recess 41 corresponding to the ring projection.

The ring 10 further comprises an attachment mechanism 40 for attaching the solitaire setting 22, and if desired, also the wing setting 24, as will be explained herein below. The attachment mechanism 40 includes a pin 42 with a two-tiered head 44, two resilient members constituted by annular-shaped springs 46 and two stopper elements constituted by thick washers 48, which typically have a cut 50 to provide the washers with a degree of resiliency and provide for a tight fit in the hole 20. The two-tiered aspect of the pin's head 44 provides a gap 51 (FIGS. 5 and 6) whereby the pin's head 44 can be conveniently gripped using one's finger-nail(s).

Figure 5:
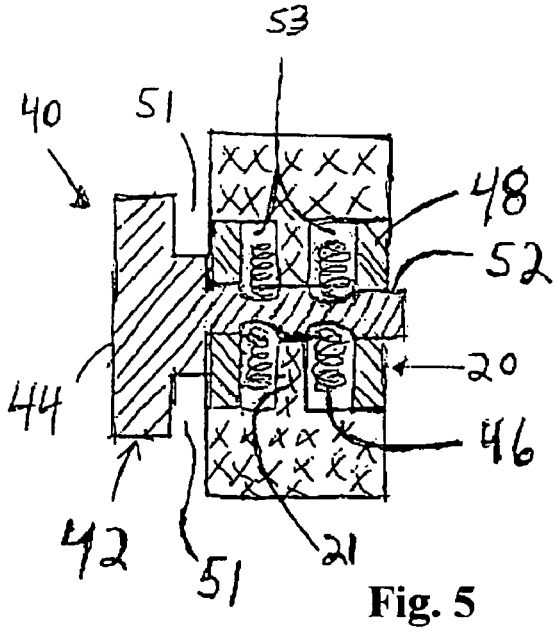
FIG. 5 is a view of portion III of FIG. 2 showing an attachment mechanism of the present invention in the assembled position.
Figure 6:
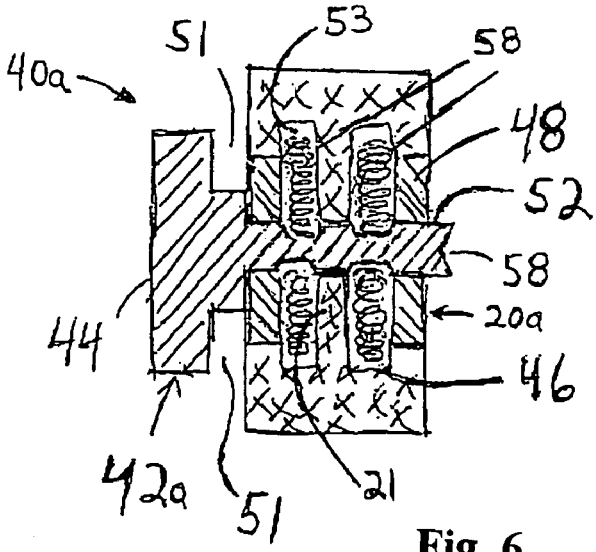
FIG. 6 is view similar to that of FIG. 5, showing a couple of exemplary modifications to the attachment mechanism of the ring of FIG. 1.

FIGS. 5 and 6 also well illustrate the positioning of the springs 46 and washers 48, the springs being sandwiched in the middle and the washers on the outside, typically flush with the front and rear surfaces 16 and 18 of the ring 10.

Also noticeable is that there is typically a small space 53 between the periphery of the springs 46 and the wall of the hole 20. This space 53 provides a volume into which the springs 46 can expand, which occurs temporarily when the pin 42 is inserted. After the pin 42 is fully inserted, the springs relax into the pin's notches 54 and the periphery of the springs 46 contract leaving the space 53.

As should be obvious from the figures (particularly FIGS. 3 and 5), the springs 46 and washers 48 are design to snugly fit within the hole 20 and the springs are separated by the annular separation element 21.

Figure 3:
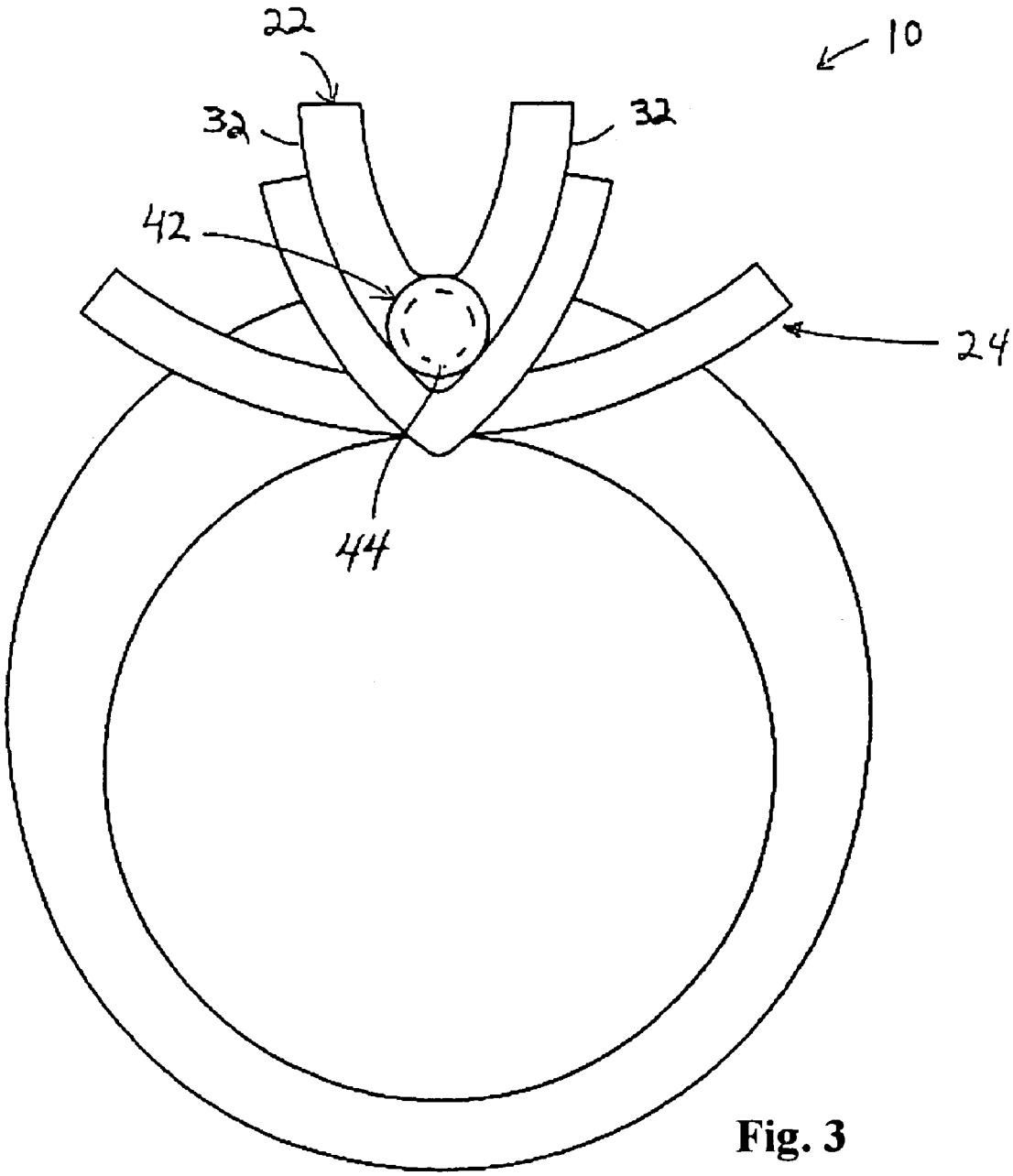
FIGS. 3 and 4 are front and side views, respectively, of the ring of the present invention showing settings assembled thereon.

The pin 42 has a stem 52 with a pair of annular notches 54 which correspond in size and location to the springs 46. The diameter of the stem 52 is typically such that it can slide through the annular separation element 21 and washers 48, but without space for shimmy or "play", and typically with some snugness of fit. However, the springs 46 are so designed so that there is required a resilient displacement thereof when the stem 52 is inserted, this resiliency being relieved only when the springs are aligned with the notches 54 to thus hold the pin 42 in place in the assembled position (FIGS. 3 and 5).

Assembly and disassembly:

When the ring 10 is assembled upon manufacture, the springs 46 and washers 48 are inserted into the hole 20, disposed in the manner described above with reference to the figures. The wing setting 24 is then slid on the ring above (i.e. adjacent to) the hole; the solitaire setting 22 is then slid on the ring above/adjacent to the hole, i.e. within the inner branches 36 of the wing setting and straddling the projection 39—if the ring includes same; and finally the pin 42 is inserted in the hole. The pin 42 is held firmly in the hole 20 by the notches 54 in the stem 52, though the resiliency of the springs 46 allows for the pin to be removed without undue force.

However, when assembled and disassembled by a user, only the pin 42 is removed and re-inserted and the springs 46 and washers 48 continue to remain snugly fixed in the hole 20. For ease of disassembly, the pin 42 is pulled out of the hole 20, typically gripped by the finger-nails.

Figure 4:
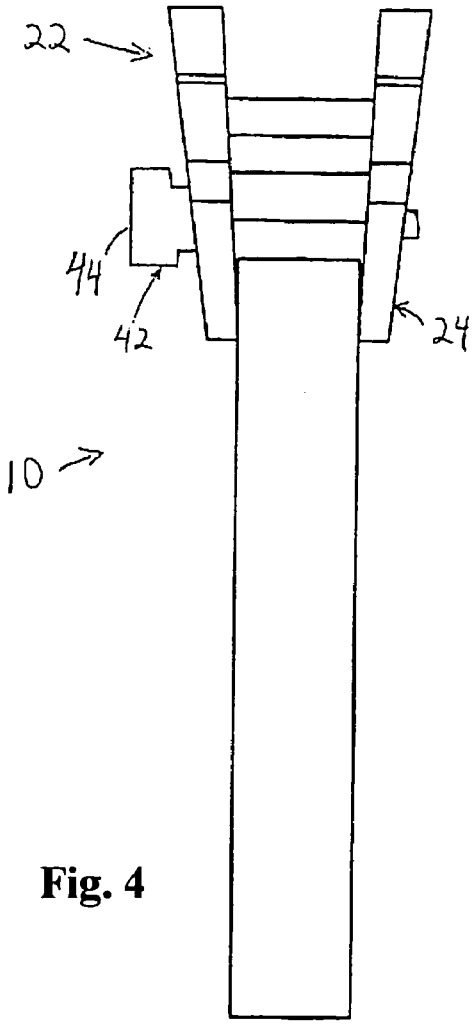

With the above-apparent ease, assembly and disassembly of the ring 10 allows either the solitaire setting 22 alone to be the ring setting or else both the solitaire setting 22 and the wing setting 24 may be set thereon to provide a gem-stone ring with a flexible look in a matter of seconds. The assembly arrangement is understood from FIGS. 1 and 2; and the arrangement of the settings 22 and 24 is shown in FIGS. 3 and 4, being examples wherein both settings are used.

Clearly, additional embodiments having other setting arrangements (e.g. additional settings in one location, additional settings in further locations using auxiliary holes, etc) can be devised within the scope of the present invention, mutatis mutandis.

FIG. 5 illustrates a couple of the many possible modifications of a ring of the present invention. For instance, it may have a modified attachment mechanism 40*a* wherein a modified hole 20*a* includes annular channels 56 adjacent the annular separation element 21. Though possibly requiring more machining in manufacture, these channels 56 may ease initial assembly of the ring 10.

Another exemplary modification is evident by a notch 58 at the distal end of a modified pin 42*a* which may be used for setting of a gem (not shown) therein.

Many embodiments of the ring and attachment mechanism of the present invention can be devised, and the following brief descriptions will illustrate a few of them.

Figure 7:
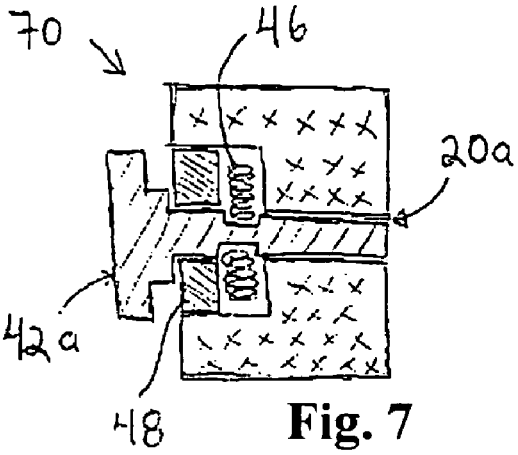
FIG. 7 is a sectional side view illustrating an embodiment of the attachment mechanism of FIG. 5.

In FIG. 7 there is shown an embodiment of an attachment mechanism 70 which is similar to those previously described, however with only one spring 46 and one washer 48 and a slightly modified hole 20*a*, being narrower in the rear portion thereof in light of there not being a second spring and washer. As noticed, a modified pin 42*a* with only one annular notch 54 is required.

FIG. 8 shows what is possibly the simplest attachment mechanism involving a pin. Here, an attachment mechanism 80 comprises a relatively simple pin 42*b* with no notches and a simple hole 20*b*. Here, the attachment aspect is constituted by a pressure fit.

Figure 9:
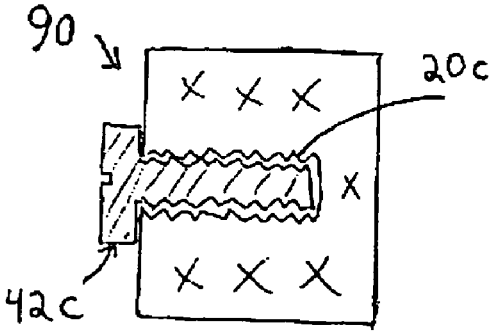

FIG. 9 shows a similar looking attachment mechanism 90 to that of FIG. 8, wherein the pin is in the form of a screw 42*c* and therefore this embodiment comprises a hole 20*c* which is threaded.

Figure 10:
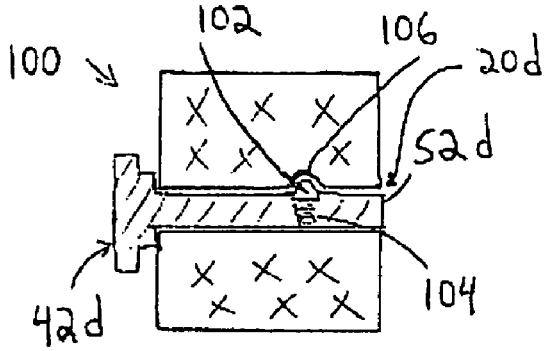

FIG. 10 shows an embodiment that uses an attaching mechanism 100 comprising a pin 42*d* with a stem 52*d* having a hemispherical ball 102 (which could be a spherical ball, a pair of balls, etc.) biased outward from the pin, by a spring 104. A hole 20*d* has a corresponding recess 106 to hold the pin 42*d* therein although is should be obvious that like in all of the embodiments, the pin can be readily removed by pulling thereon, unscrewing it, or as the case may be.

Figure 11:
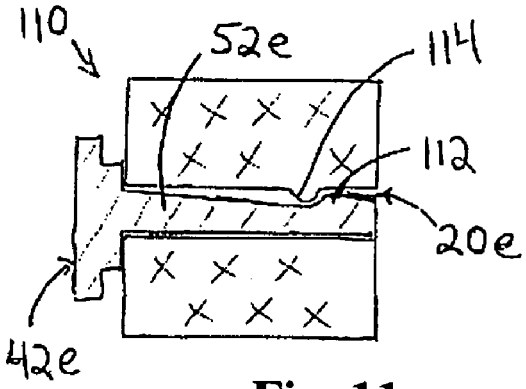

FIG. 11 shows yet another exemplary embodiment of an attachment mechanism 110 usable in a ring of the present invention wherein there is a pin 42*e* whose stem 52*e* has a small and smooth projection 112 which is designed to be held behind a projection 114 of a hole 20*e*. To aid in the force holding the pin 42*e* in the hole 20*e*, the stem may undergo a minor bending upon insertion; and removal upon disassembly/removal.

Figure 12:
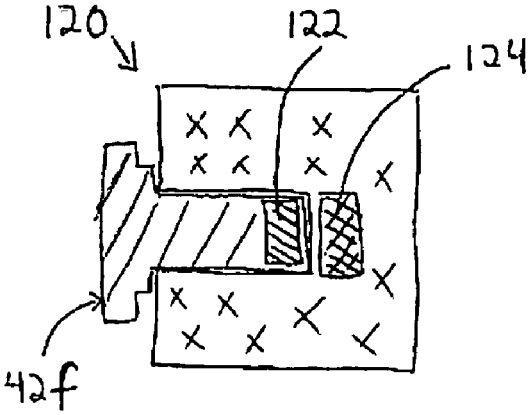

FIG. 12 illustrates an attachment mechanism 120 wherein the ring has a pin 42*f* with a magnet 122 adjacent its distal end. Housed in the ring is another magnet 124, typically at a location adjacent that of the pin's magnet 122. The pin 42*f* is thus held in the ring when in the assembled situation, yet the pin can be readily removed for allowing a different setting arrangement to be used.

Figure 13:
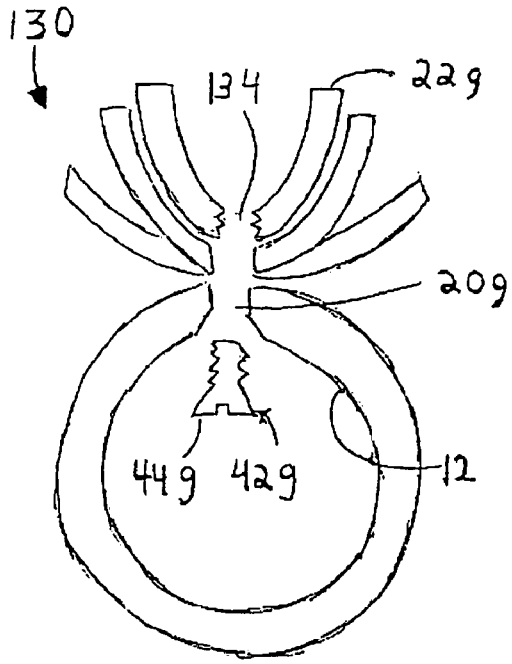

FIG. 13 illustrates an attachment mechanism 130 wherein the ring has a vertical hole 20*g* with a pin 42*g* typically inserted in a direction entering via the inner surface 12 of the ring. The pin 42*g* may have a head 44*g* designed to correspond to a depression 132 in the hole 20*g* so that the inner surface 12 is smooth and comfortable for a wearer's finger. Furthermore, the pin's head 44*g* is typically flat or slightly contoured for the same reason. The pin 42*g* has been shown in the form of a screw and thus there is shown a solitaire setting 22*g* with a threaded bore 134.

Figure 14:
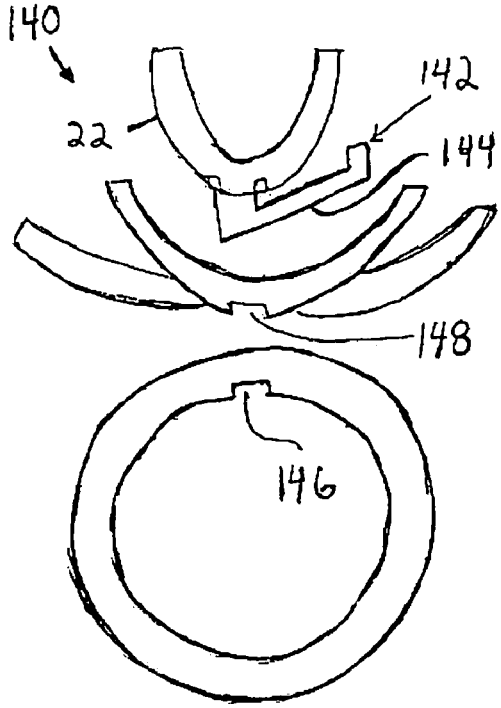

FIG. 14 illustrates another attachment mechanism 140 of a somewhat different type than those previously described. Here, the mechanism 140 comprises a clasp 142 which can be attached, typically, to the solitaire setting 22. To close the clasp 142 (assemble the setting(s) on the ring) the clasp has an arm 144 which is moved under the inner surface 12 and clasped on the other side of the solitaire setting 22. There is typically a notch 146 in the inner surface 12 and a notch 148 in the wing setting 24 to accommodate the arm 144 of the clasp 142 which also has the effect of holding the settings 24 and/or 22 at a particular position and provides for a comfortable inner surface. However, a variety of attachment mechanisms, including those described herein and not described herein, may be used, mutatis mutandis.

Figure 1:
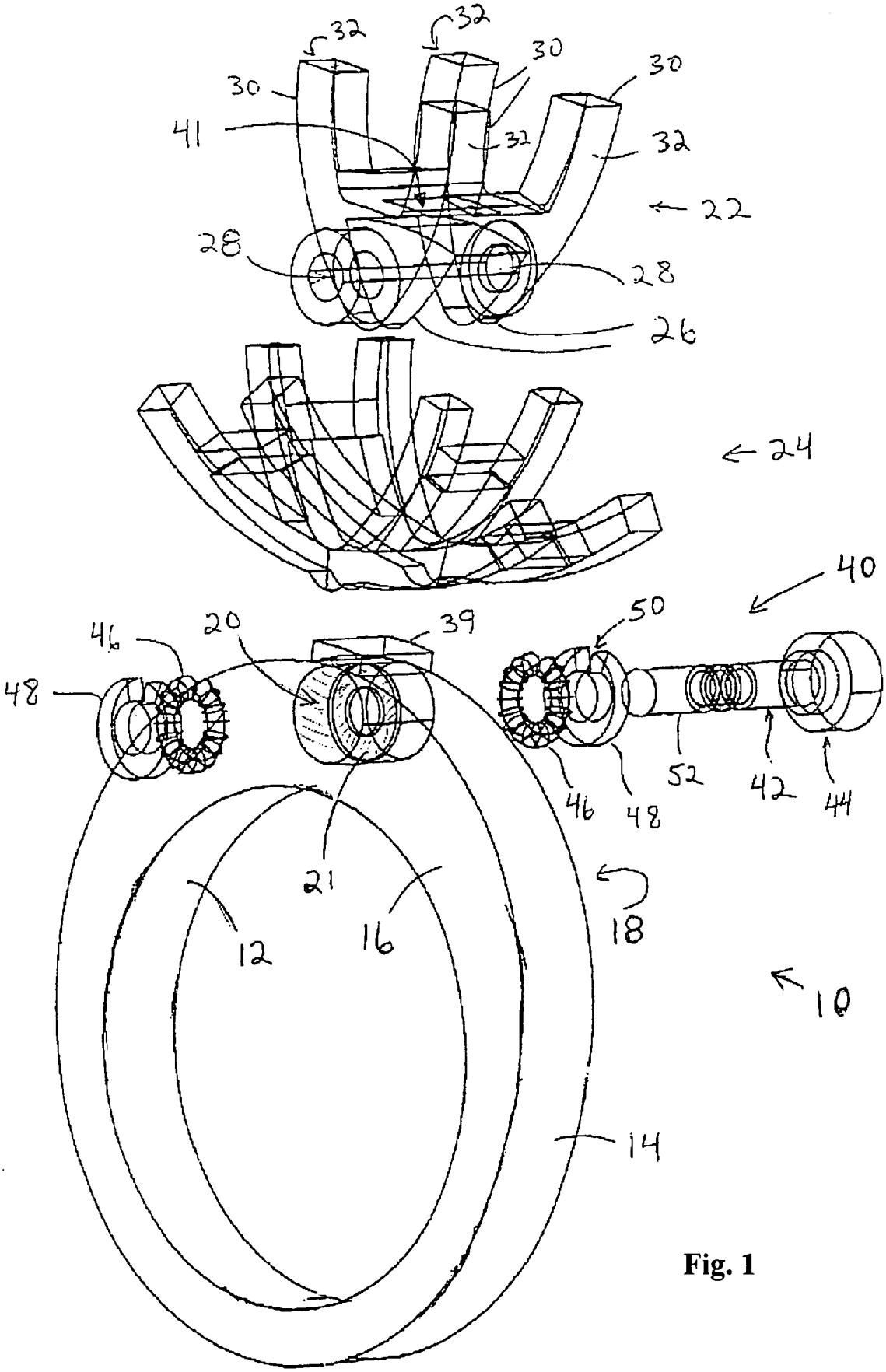
FIG. 1 is a perspective exploded view of a first embodiment of a ring according to the present invention.
Figure 2:
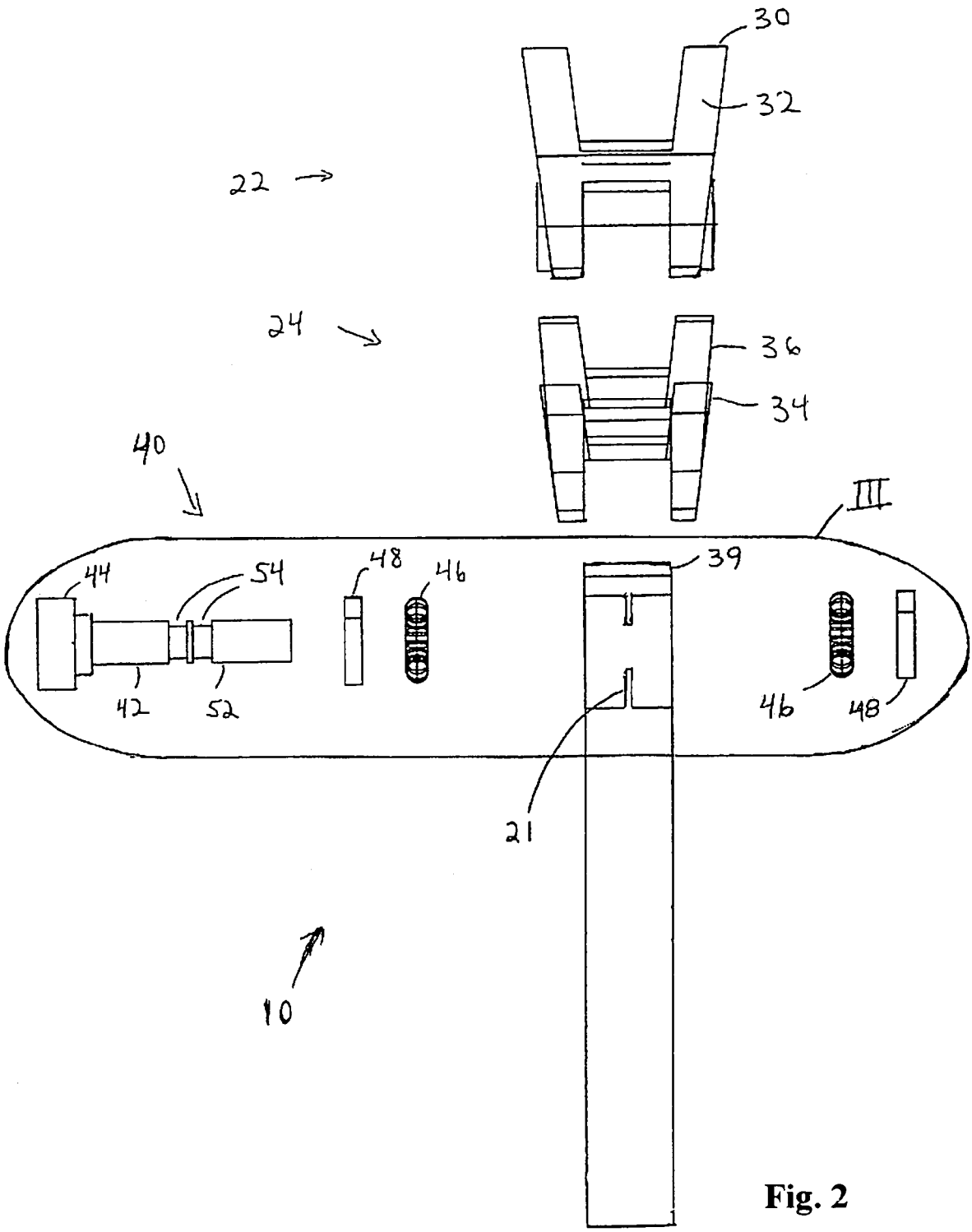
FIG. 2 is an exploded sectional side view of the ring of FIG. 1.
Figure 15:
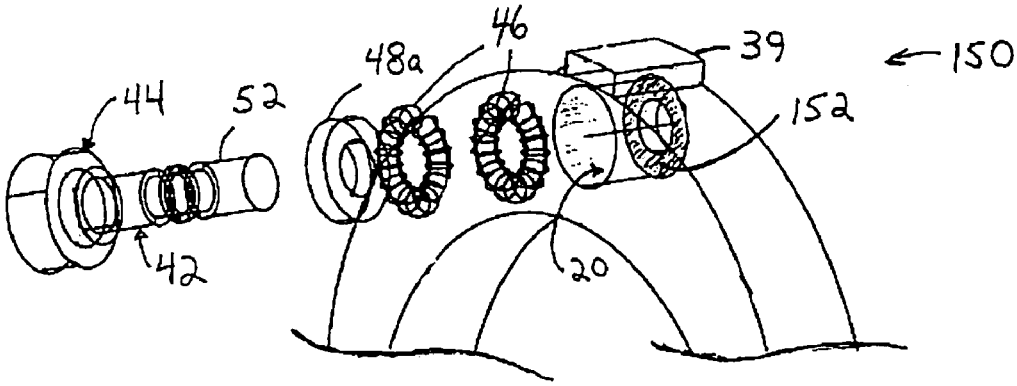

FIG. 15 illustrates yet another attachment mechanism 150, which is fairly similar to that of FIG. 1. One of the main differences is that instead of the washer 48 that is adjacent the head 44 of the pin 42, there is a ring portion or stopping member 152 that blocks the spring 46, adjacent thereto. Thus there is a need for only one washer, for example, a washer 48*a*, which is similar to washer 48 except that it is typically of a completely annular configuration, i.e. with no cut 50.

It should be clearly understood by now that many attachment mechanisms could be employed (including those not described or illustrated herein, which may use snap fitting arrangements, L-shaped slots for locking via entry and rotation, or a variety of other methods and configurations) to achieve the particular feature of a ring of the present invention in which the settings thereof can be removed and selectively replaced.

It should be noted, with consideration of its geometry, an existing ring may potentially be adapted (e.g. machined) to have an appropriate hole, notch, (for example as described above), or the like, whereby an attachment mechanism of the present invention could be retro-fitted for use in an existing ring after the ring is appropriately adapted—typically by machining. As such, various settings, for example those mentioned herein, could be connected to such an adapted ring.

While a number of embodiments of the jewelry and attachment mechanism of the present invention have been described, it should obvious to one skilled in the art that there are various rings and attachment mechanisms that can be devised according to the present invention with numerous modifications possible and that the above description is merely explanatory.

The invention claimed is:

1. A jewelry piece, comprising:

at least one replaceable/exchangeable jewelry setting, said piece adapted to be assembled with one of said at least one jewelry setting or a combination of said jewelry settings; and at least one attachment mechanism, each of said at least one attachment mechanism for attaching one of said at least one jewelry setting to said jewelry piece, each said attachment mechanism comprising:

a hole in the jewelry piece;

an annular channel in the hole;

a spring disposed in the annular channel; and a pin inserted in said hole, said pin comprising a stem and a two-tiered head and having a notch corresponding to said spring;

wherein tension of the spring acting on the notch of the pin holds the pin firmly in place to secure the jewelry setting to the jewelry piece and enables removal of the pin against the tension of the spring without undue force in order to release the jewelry setting from the jewelry piece.

2. The jewelry piece according to claim 1, wherein the attachment mechanism further comprises a stopper in the hole adjacent the spring.

3. The jewelry piece according to claim 1, wherein the hole has more than one annular channel with a corresponding spring disposed in each channel.

4. The jewelry piece according to claim 1, further comprising a projection at a peripheral location of said piece and an opening or recess in the at least one jewelry setting corresponding to said projection for facilitating positioning of the at least one jewelry setting on said piece.

5. The jewelry piece according to claim 1, wherein said jewelry piece comprises one of a ring, an earring, a bracelet, a necklace, a belt buckle, and a head-dress piece.

6. A jewelry piece, comprising:

at least one replaceable/exchangeable jewelry setting, said piece adapted to be assembled with one of said at least one jewelry setting or a combination of said jewelry settings; and at least one attachment mechanism, each of said at least one attachment mechanism for attaching one of said at least one jewelry setting to said jewelry piece, each said attachment mechanism comprising:

a hole in the jewelry piece;

an annular channel in the hole;

a spring disposed in the annular channel; and a pin inserted in said hole, said pin having a notch corresponding to said spring;

wherein:

tension of the spring acting on the notch of the pin holds the pin firmly in place to secure the jewelry setting to the jewelry piece and enables removal of the pin against the tension of the spring without undue force in order to release the jewelry setting from the jewelry piece; and said piece comprises more than one attachment mechanism.

7. The jewelry piece according to claim 6 wherein the pin comprises a stem and a two-tiered head.

8. The jewelry piece according to claim 6, wherein the attachment mechanism further comprises a stopper in the hole adjacent the spring.

9. The jewelry piece according to claim 6, wherein the hole has more than one annular channel with a corresponding spring disposed in each channel.

10. The jewelry piece according to claim 6, further comprising a projection at a peripheral location of said piece and an opening or recess in the at least one jewelry setting corresponding to said projection for facilitating positioning of the at least one jewelry setting on said piece.

11. The jewelry piece according to claim 6, wherein said jewelry piece comprises one of a ring, an earring, a bracelet, a necklace, a belt buckle, and a head-dress piece.

12. An attachment mechanism for attaching a jewelry setting to a jewelry piece, comprising:

a hole in the jewelry piece;

an annular channel in the hole;

a spring disposed in the annular channel; and a pin inserted in said hole, said pin comprising a stem and a two-tiered head and having a notch corresponding to said spring;

wherein tension of the spring acting on the notch of the pin holds the pin firmly in place to secure the jewelry setting to the jewelry piece and enables removal of the pin against the tension of the spring without undue force in order to release the jewelry setting from the jewelry piece.

* * * * *